United States Patent [19]

Bright

[11] B 3,984,996

[45] Oct. 12, 1976

[54] VERTICAL TUBE ICE MAKER

[75] Inventor: James A. Bright, Dayton, Ohio

[73] Assignee: General Motors Corporation, Detroit, Mich.

[22] Filed: Apr. 2, 1975

[21] Appl. No.: 564,314

[44] Published under the second Trial Voluntary Protest Program on January 20, 1976 as document No. B 564,314.

[52] U.S. Cl. ..... 62/353; 62/71

[51] Int. Cl.[2] ..... F25C 1/06; F25C 1/12

[58] Field of Search ..... 62/353, 340, 71

[56] References Cited

UNITED STATES PATENTS

| | | | |
|---|---|---|---|
| 2,542,891 | 2/1951 | Bayston | 62/353 X |
| 3,861,163 | 1/1975 | Carpenter | 62/353 X |
| 3,896,631 | 7/1975 | Morrison | 62/71 |

*Primary Examiner*—William E. Wayner
*Attorney, Agent, or Firm*—Edward P. Barthel

[57] ABSTRACT

An open-ended non-circular sectioned vertical tube is supported in a lower insulated housing providing a heated water reservoir to fill the tube to a predetermined level. A threaded shaft is rotated about its axis in the tube such that upon a refrigeration medium subjecting the outer surface of the tube to a below freezing temperature the water therein is frozen into an ice column starting at the tube inside surface and continuing toward the shaft. The rotating shaft advances the non-circular ice column upwardly whereupon harvesting mechanism is actuated by the column to sever the same into uniform ice pieces for transfer into an ice storage container.

5 Claims, 5 Drawing Figures

VERTICAL TUBE ICE MAKER

The present invention relates to an improved vertical tube ice maker for making relatively clear uniform ice pieces, and more particularly to such apparatus for refrigerators.

As stated in applicant's prior art U.S. patent No. 3,775,992, relatively clear ice pieces in the form of "cubes" has been a desire of users and a goal of manufacturers for years. Apparatus for making relatively clear uniform ice cubes, however, has been expensive, cumbersome and suited mainly to commercial manufacture of ice. Heretofore, no one has simplified vertical tube automatic ice cube makers to the point where they are suitable in size, cost and operation to the relatively small confines of the freezer in a domestic refrigerator.

Accordingly, it is an object of this invention to provide an automatic ice maker for producing substantially uniform ice pieces from a body of water in a vertical tube ice forming chamber having a non-circular cross section, the tube being cooled by refrigeration means to a below freezing temperature to form a non-circular ice column whereby screw means rotatably mounted in the chamber continuously move the ice column vertically out of the tube into an ice piece harvesting mechanism.

A more specific object of this invention is to provide an improved relatively clear ice piece maker for use in the freezer of a domestic refrigerator wherein an ice column may be formed within an ice forming chamber of a vertical tube having a non-circular cross section. The tube lower end communicates with a water reservoir having heating means to keep the water therein from freezing while the refrigerator circulates below freezing air around the tube causing a portion of the water in the chamber to freeze into an ice column starting at the tube inner surface and continuing toward a coaxial threaded shaft rotatably mounted in the chamber, whereby upon rotation of the shaft the ice column is moved vertically out of the chamber allowing harvesting mechanism to successively sever the ice column into uniform ice pieces having a central opening extending therethrough with the cross section of the ice pieces being identical to the cross section of the chamber.

It is still another object of the present invention to provide an ice piece severing mechanism for a vertical tube automatic ice cube maker, wherein a column of ice is fed vertically upwardly from the tube between a pair of identical paddle wheels mounted on horizontal axis for rotation in an opposite synchronous manner, each wheel having a plurality of radial blades mounted thereon such that each pair of opposed blades engage the ice column successively as the wheels are rotated by the force of the moving ice column. The paired blades are rotated toward an inwardly opposed coplanar position to sever an ice piece from the top of the ice column while the upwardly moving ice column continues to rotate the wheels until the next pair of opposed blades grip a succeeding lower portion of the column to repeat the operation.

Further objects and advantages of the present invention will be apparent from the following description, reference being had to the accompanying drawings wherein a preferred embodiment of the present invention is clearly shown.

Figure 1:
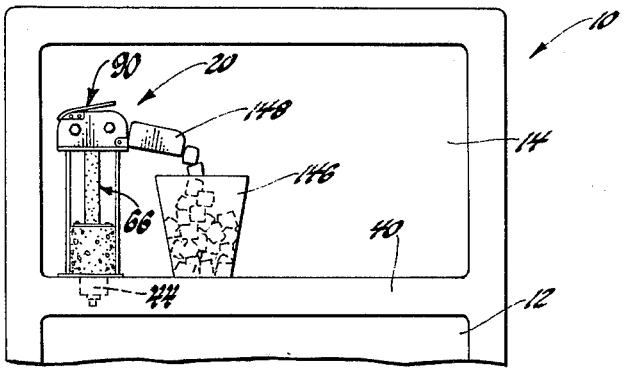
FIG. 1 is a fragmentary front elevational view of a household refrigerator freezer compartment with the door removed illustrating one form of the automatic ice maker.
Figure 2:
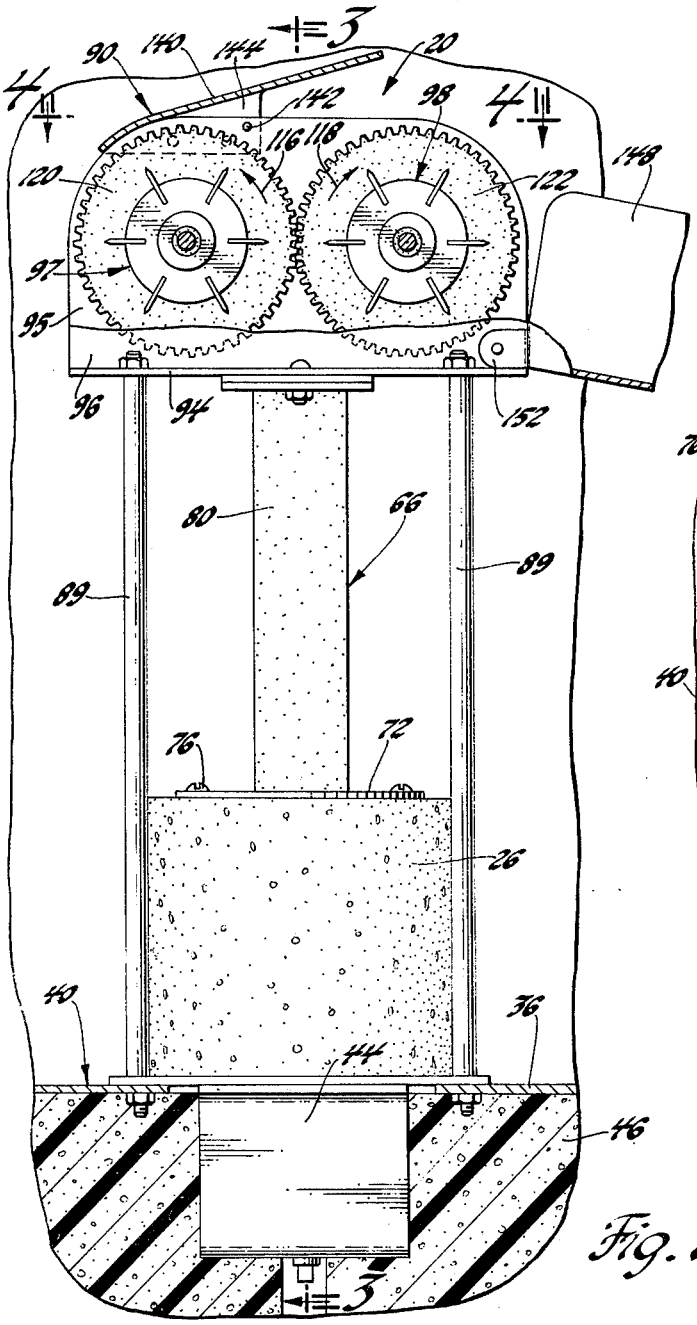
FIG. 2 is an enlarged vertical elevational view, partly in section, of the ice maker of FIG. 1.

Referring now to the drawings, there is shown in FIG. 1 the upper portion of a top freezer household refrigerator cabinet 10 with the doors removed showing a lower above-freezing food compartment 12 and an upper freezer compartment 14. Preferably, this household refrigerator 10 is of the frost-free type in which air at a temperature of the order of −5° – 15° F. is circulated through the freezer compartment 14. One example of such a refrigerator is shown in U.S. Pat. No. 3,050,961 to Mann et al assigned to the assignee of the instant application, the disclosure of which is incorporated by reference herein.

Figure 3:
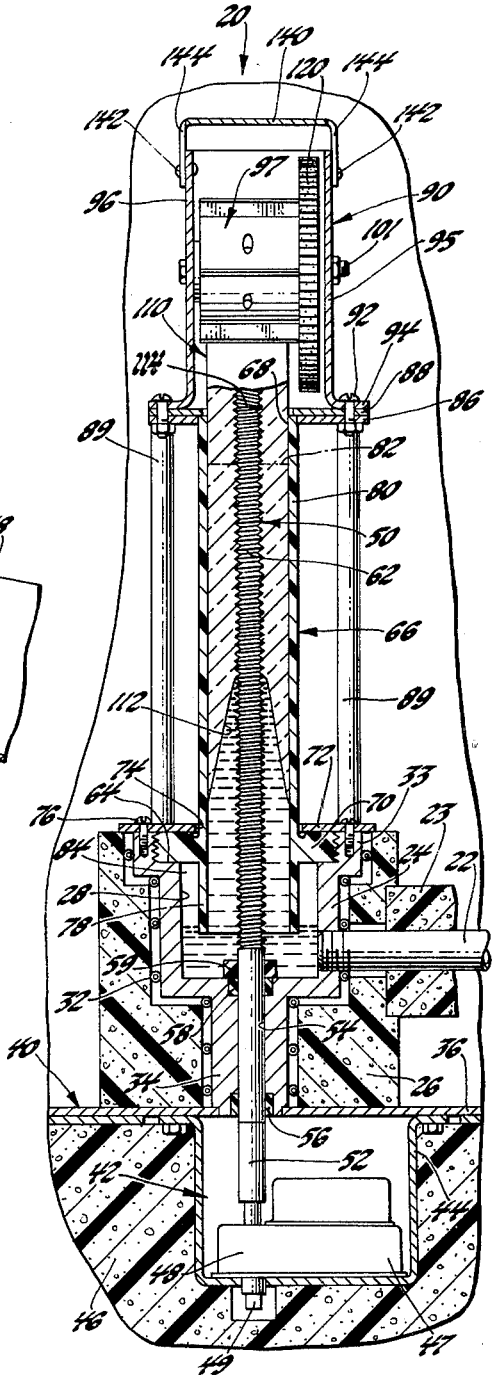
FIG. 3 is a vertical sectional view taken substantially on line 3—3 of FIG. 2.

According to my invention, an automatic vertical tube ice maker, generally indicated at 20, is installed in the freezer compartment 14 supplied with tap water from an ordinary household supply at ambient temperatures via suitable water fill means which controls the flow of water through conduit means shown at 22 in FIG. 3 having an insulated sheath 23 for introducing water into the compartment of fill tank 24 located within housing 26 formed of suitable insulating material such as expanded foam insulation.

The fill tube 22 is connected with the water fill means which in the preferred embodiment is a reservoir located on the back wall of the refrigerator cabinet (not shown) adapted to contain water in liquid state at a predetermined level. The constant level in the reservoir may be controlled by float means to maintain a constant level water within the compartment 28 of the tank 24. Such water fill means is disclosed generally in U.S. Pat. No. 3,775,992 issued to the inventor of the present application the disclosure of which is incorporated by reference herein.

As seen in FIG. 3, the tank 24 is provided with heating means in the form of resistance heater 32 adapted for heating the sides, bottom, upper lip 33 and hub 34 of the cylindrical tank 24. The hub 34 is shown supported on the shelf cover sheet 36 of the refrigerator horizontal divider partition 40. The ice maker power section 42 is contained within drive housing 44 recessed in the partition insulation which is preferably freon-filled urethane foam insulation 46. The power section includes an electric motor 47, enclosed gear means 48 and a driven upright shaft 49 suitably coupled to a rotatable shaft 50 by coupling means 52.

The hub 34 has a vertical bore 54 for receiving the shaft 50 in a sealed manner by a lower hub sealing ring 56 and upper tank sealing rings 58 and 59. The shaft 50 has formed on its upper end helical threads 62 which in the disclosed form are left hand smooth V threads, with eight threads per in., having an outside diameter of about 0.375 inches. The shaft 50 is preferably of stainless steel material.

Figure 4:
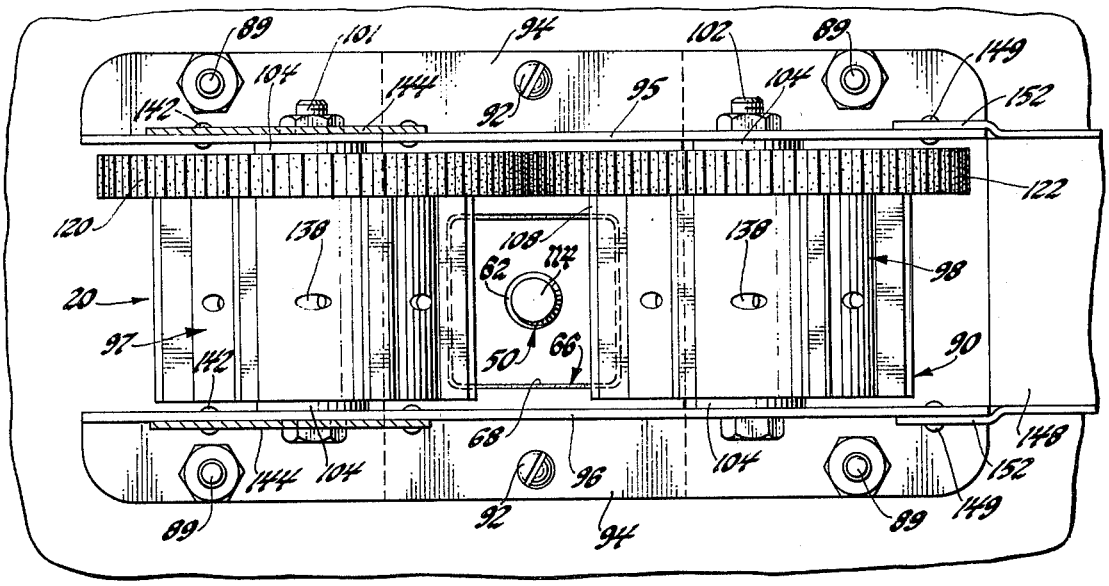
FIG. 4 is an enlarged horizontal elevational view taken on line 4—4 of FIG. 2.

Supported within the counterbored seat 64 of the tank is an upright or vertical tube member generally indicated at 66 preferably having a square cross section, the inner surface of which is shown at 68 in FIG. 4. The vertical tube 66 is preferably molded of plastic material such as polypropylene and includes an integral cylindrical collar 70 which is shown threaded into the tank lip portion 33. A circular tank cover plate 72, having a square aperture 74, is retained on the tank by machine screws 76. The lower section 78 of the vertical tube extends downwardly into the tank chamber 28 a predetermined distance such that upon the initial water charge entering the chamber it will rise within the tube upper section 80 to an initial predetermined level indicated by dashed line 82. It will be noted in FIG. 3 that because of the trapped air space 84 within the sealed chamber 28 the water surface in the tank 24 will stabilize at the level shown sufficient to submerge the lower end of tube section 78.

The upper edge of the vertical tube section 80 is shown flush with a lower plate 86 having a square aperture conforming to the outer surface of the tube section 80 while an upper plate 88 has a square aperture conforming to the inner surface 68 of the tube. The two plates 86 and 88, together with the upright four posts 89, support ice harvesting means in the form of an ice harvesting mechanism generally indicated at 90. It will be noted in FIG. 3 that the upper end of the shaft 50 is substantially flush within the upper surface of top mounting plate 88.

Suitable fasteners such as bolts 92 secure the lower out turned flanges 94 of vertical walls 95 and 96 which rotatably support therebetween a pair of identical paddle wheels or drums 97 and 98 supported for rotary movement about generally horizontal parallel axis by means of transverse wheel or drum axles 101 and 102, respectively, shown in the form of bolts each with a pair of inner spacing washers 104. The wheel drums have spaced around their periphery a plurality of lifting and cutting or severing blade means in the form of radial vanes or blades 106*a*, 106*b*, 106*c*, 106*d*, 106*e* and 106*f* extending parallel to the horizontal axis of rotation of the drum. Each of the vanes has at its outward edge a straight cutting knife edge 108 which edge has a length greater than the width of the tube inner surfaces 68.

Figure 5:
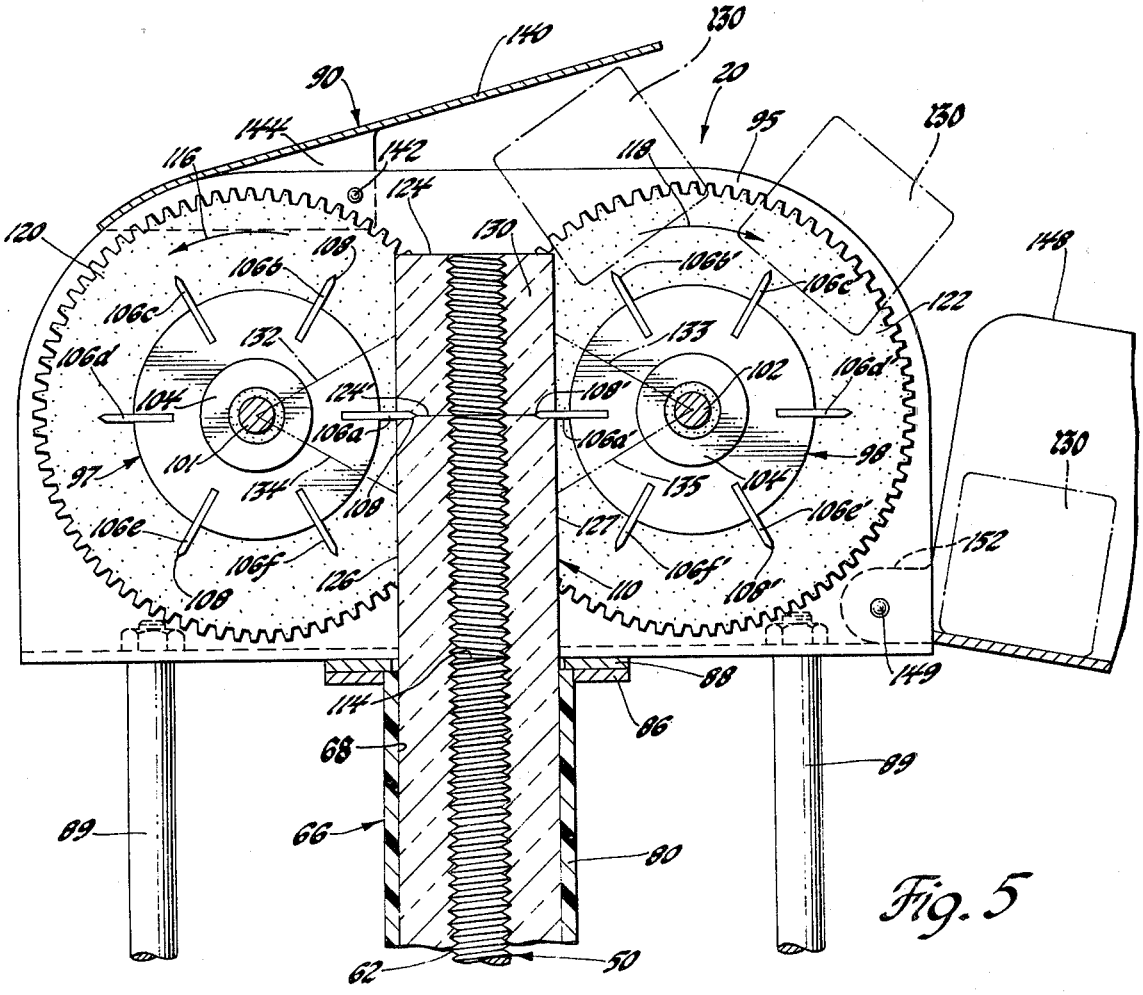
FIG. 5 is an enlarged fragmentary vertical elevational view, partly in section, of the ice harvesting mechanism.

When the blade 106*a* of wheel 97 and the blade 106*a'* of wheel 98 are positioned in opposed adjacent relation, as shown in FIG. 5, so as to lie in a common horizontal plane, their respective knife edges 108 and 108' are spaced apart less than the width of a non-circular cross section homogeneous or hollow ice column 110 which is shown extending vertically between the wheels 97 and 98 such that an extension of the vertical axis of rotation of the threaded shaft 50 is equally spaced from the horizontal axis of said wheels.

The ice column 110 is formed in the tube 66 by virtue of first freezing on the inside surface 68 of the tube and then progressively inwardly toward the threaded shaft 50 that is slowly rotating about one revolution per minute in the disclosed form, while the water in the reservoir chamber 28 is maintained above freezing (about 36° F.) by means of the electric heater 32 and insulated housing 26. Upon the water adjacent the screw freezing the ice column 110 is completed and begins to move upward with the screw thread 62. Thus, with the ice column moving upward at about the same rate that the water in the tube is being frozen the continuous column of ice is formed having a generally conical lower shape 112 delineating the surface between the ice column and the lower unfrozen water in the upper tube portion 80. It will be noted that while the completed ice column shown in FIG. 5 above the shaft top 114 has a substantially square cross section with an axial or control opening extending therethrough it will be appreciated that other polygonal cross sectional shapes could be provided such as a rectangle, triangle, etc., as long as the column is non-circular in cross section.

As the ice column moves upwardly beyond the top 114 of the shaft 50 and between the paddle wheels 97 and 98 it engages a pair of corresponding blades resulting in the wheels 97 and 98 to be revolved in unison in opposed directions as shown by the arrows 116 and 118, respectively. The wheels are maintained in synchronism by means of the meshing relation of their associated concentric gear members shown at 120 and 122 with the gear 120 fixed to one end of wheel 97 and the gear 122 similarly fixed to wheel 98. Thus, as the ice column upper surface 124 engages a pair of opposed vanes 106*b* and 106*b'* it revolves the drums in opposite directions, drum 97 in a counterclockwise direction as shown by arrow 116 and drum 98 in a clockwise direction as shown by arrow 118, until the next pair of vanes 106*a* and 106*a'* have their knife edges 108 and 108' engage the opposed outer ice column surfaces 126 and 127. Continued upward movement causes the knife edges 108 and 108' of vanes 106*a* and *a'* to penetrate the ice column until they achieve maximum penetration shown in FIG. 5.

At this point the vanes 106*a* and *a'* sever or fracture the ice column and form an ice mass or "cube" 130. The ice column 110, however, now has a new upper surface 124' which continues to contact the undersurface of the vanes 106*a* and *a'* and thus continues to rotate the drums 97 and 98 until the vanes 106*a* and *a'* reach an arcuate position indicated by the dashed lines 132 and 133 when the vanes 106*a* and *a'* are about to be rotated out of contact with the ice column. At this point the next adjacent pair of vanes 106*f* and *f'* have been rotated to coincide with dashed lines 134 and 135 where their knife edges 108 and 108' will penetrate the ice column 110 such that the drums will continue to be rotated until the vanes reach their coplanar horizontal adjacent positions to sever another ice piece and so on to provide a continuous supply thereof. In the disclosed embodiment the vanes 106 are retained in slots formed in their associated drums by set screws threaded in the tangential holes 138 in the drums.

As seen in FIG. 5 the ice pieces are deflected by suitable means such as angled shield 140 which is secured to side walls 95 and 96 as by rivets 142 extending through integral shield gussets 144. The ice pieces are thus carried around drum 98 by its vanes and deposited by gravity into collecting bin 146 by delivery means such as the inclined delivery chute 148 secured as by rivets 149 to the side walls 94 and 95 by ears 152.

While the embodiment of the present invention as herein disclosed constitutes a preferred form, it is to be understood that other forms might be adopted.

I claim:

1. In an automatic ice piece maker, a vertically extending tubular member defining an ice forming chamber having an upper open end, said chamber having a non-circular cross section, means forming a water supply inlet to said chamber adjacent the lower end thereof, refrigeration means for freezing the water in said chamber, a threaded shaft rotatably mounted within said chamber, said shaft threads having their major diameter in sufficiently spaced relation to the inside surface of said chamber to permit the formation of an ice column therein, the ice column having a non-circular cross section conforming to the cross section of said chamber, whereby the ice column is locked against rotational movement in said chamber; internal threads being formed by the ice column in mating relation with said shaft threads, means for rotating said shaft about its axis of rotation whereby the ice column is moved vertically upward out of said chamber upper open end, and ice harvesting means above said chamber open end operative for successively removing a top portion from the upwardly driven ice column to produce substantially uniform ice pieces with each ice piece having a non-circular cross section substantially conforming to the cross section of said chamber.

2. In an automatic ice piece maker, a vertically extending tubular member defining an ice forming chamber having an upper open end, said chamber having a non-circular cross section, means forming a water supply inlet to said chamber adjacent the lower end thereof, refrigeration means for freezing the water in said chamber, a threaded shaft rotatably mounted within said chamber, said shaft threads having their major diameter in sufficiently spaced relation to the inside surface of said chamber to permit the formation of an ice column therein, the ice column having a non-circular cross section conforming to the cross section of said chamber, whereby the ice column is locked against rotational movement in said chamber; internal threads being formed by the ice column in mating relation with said shaft threads, means for rotating said shaft about its axis of rotation whereby the ice column is moved vertically upward out of said chamber upper open end, and ice harvesting means above said chamber open end operative for successively removing from the top of the upwardly driven ice column substantially uniform ice pieces with each ice piece having a non-circular cross section substantially conforming to the cross section of said chamber, said ice harvesting means including a pair of wheel means rotatably supported about horizontal axis spaced on either side of the upwardly moving ice column, means for rotating said wheels in opposed synchronism in the same direction as the upward travel of the ice column, each said wheel means having a plurality of radially extending blades, the blades of each said wheel means being arranged in paired mirror image relation whereby upon the ice column contacting a first pair of blades said wheel means are rotated in unison by the movement of the ice column, said first pair of blades operative to sever a uniform ice piece from the upper portion of the column, and whereby the next successive pair of blades are rotated to engage the ice column prior to the first pair of blades being rotated out of driven contact with the ice column.

3. In combination with an insulated cabinet wall defining a freezer compartment adapted to contain air at subfreezing temperatures, an automatic ice piece maker in said freezer compartment, said ice maker comprising a lower reservoir, a vertically extending tubular member defining an ice forming chamber having upper and lower open ends, said chamber having a non-circular cross section, said tubular member lower open end supported within said reservoir, water fill means for filling said tube with water to a predetermined level after introducing water into said reservoir, means for heating said water to an above-freezing temperature so as to retain said reservoir water in a liquid state, a threaded shaft rotatably mounted within said chamber, said shaft threads having their major diameter in sufficiently spaced relation to the inside surface of said chamber to permit the formation of an ice column therein, the ice column having a non-circular cross section conforming to the cross section of said chamber, whereby the ice column is locked against rotational movement in said chamber; internal threads being formed by the ice column in mating relation with said shaft threads, means for rotating said shaft about its axis of rotation whereby the ice column is moved vertically upward out of said chamber upper open end, and ice harvesting means above said chamber open end operative for successively removing from the top of the upwardly driven ice column substantially uniform ice pieces with each ice piece having a non-circular cross section substantially conforming to the cross section of said chamber.

4. In combination, a domestic freezer, an automatic ice piece maker in said freezer comprising a lower reservoir, a vertically extending tubular member defining an ice forming chamber having upper and lower open ends, said chamber having a rectangular cross section, said tubular member lower open end supported within said reservoir, water fill means for filling said tube with water to a predetermined level after introducing water into said reservoir, means for heating said water to an above-freezing temperature so as to retain said reservoir water in a liquid state, a threaded shaft rotatably mounted within said chamber, said shaft threads having their major diameter in sufficiently spaced relation to the inside surface of said chamber to permit the formation of an ice column therein, the ice column having a rectangular cross section conforming to the cross section of said chamber, whereby the ice column is locked against rotational movement in said tube; internal threads being formed by the ice column in mating relation with said shaft threads, means for rotating said shaft about its axis of rotation whereby the ice column is moved vertically upward out of said chamber upper open end, and ice harvesting means supported above said chamber open end operative for successively removing from the top of the upwardly driven ice column substantially uniform ice pieces with each ice piece having a rectangular cross section substantially conforming to the cross section of said chamber, said ice harvesting means comprising a frame, a pair of oppositely rotatable drums mounted for rotation on spaced parallel horizontally extending shafts carried by said frame, a plurality of angularly spaced radially extending blades carried by and projecting from the peripheral surface of each of said drums, whereby the blades of one drum are in paired spaced mating relationship to the blades of the other drum, gear means for maintaining said drums in synchronism as said drums are rotated in the same direction as the upward travel of the ice column, whereby upon the ice column contacting a first pair of blades said drums are rotated by the ice column, said first pair of mating blades operative to sever an ice piece from the upper portion of the ice column as the first pair of blades are rotated into a common horizontal plane, and whereby the next succeeding pair of mating blades are rotated to engage the ice column prior to the first pair of mating blades being rotated out of contact with the ice column.

5. Apparatus for harvesting ice blocks from a column of ice advanced upwardly from an ice forming chamber of a vertical tube ice maker, the ice column substantially rectangular in horizontal cross section, the ice maker including drive means for moving the column of ice vertically out of the upper open end of said chamber at a substantially constant rate; said apparatus comprising a frame supported above the chamber open end, a pair of oppositely rotatable wheel means mounted for rotation on spaced parallel horizontally extending shafts carried by said frame, a plurality of angularly spaced radially extending blades carried by and projecting from each of said wheel means, whereby the blades of one wheel means are in paired spaced mating relationship to the blades of said other wheel means, means for maintaining said wheel means in synchronism while they are being rotated in the same direction as the upward travel of the column of ice, upon said drive means moving the column of ice into contact with a first pair of mating blades said wheel means being rotated in unison by the column of ice, said first pair of mating blades operative to sever and remove an ice block from the upper portion of the column of ice as said first pair of blades are rotated into a common horizontal plane, and whereby said blades being angularly spaced such that the next succeeding pair of mating blades are rotated to engage the column of ice prior to said first pair of mating blades being rotated out of driven contact with the column of ice.

* * * * *